US008914945B2

(12) United States Patent
Callahan

(10) Patent No.: US 8,914,945 B2
(45) Date of Patent: Dec. 23, 2014

(54) DOOR STOPPER AND METHOD OF USE

(71) Applicant: Patrick F. Callahan, Reno, NV (US)

(72) Inventor: Patrick F. Callahan, Reno, NV (US)

( * ) Notice: Subject to any disclaimer, the term of this patent is extended or adjusted under 35 U.S.C. 154(b) by 0 days.

(21) Appl. No.: 13/928,359

(22) Filed: Jun. 26, 2013

(65) Prior Publication Data

US 2013/0340204 A1 Dec. 26, 2013

Related U.S. Application Data

(60) Provisional application No. 61/664,170, filed on Jun. 26, 2012.

(51) Int. Cl.
*E05F 5/00* (2006.01)
*E05F 5/02* (2006.01)
*E05C 17/00* (2006.01)

(52) U.S. Cl.
CPC ..... *E05F 5/02* (2013.01)
USPC ..... 16/82

(58) Field of Classification Search
CPC ..... E05C 17/203; E05F 5/04; E05F 3/221
USPC ..... 16/82, 83, DIG. 17
See application file for complete search history.

(56) References Cited

U.S. PATENT DOCUMENTS

| | | | | | |
|---|---|---|---|---|---|
| 870,216 | A | * | 11/1907 | Bennett et al. | 292/228 |
| 1,258,856 | A | * | 3/1918 | Beaudette | 16/83 |
| 1,921,568 | A | * | 8/1933 | Hasselberger | 292/344 |
| 2,107,699 | A | * | 2/1938 | Groeschel et al. | 16/86 A |
| 3,141,188 | A | * | 7/1964 | Gray | 16/86 A |
| 3,156,001 | A | * | 11/1964 | Schmid | 16/64 |
| 3,187,372 | A | * | 6/1965 | Parsons | 16/375 |
| 3,731,341 | A | * | 5/1973 | Woodruff | 16/82 |
| 3,877,108 | A | * | 4/1975 | Del Fiacco | 16/49 |
| 4,165,553 | A | * | 8/1979 | Salerno | 16/86 A |
| 4,261,140 | A | * | 4/1981 | McLean | 49/383 |
| 4,310,947 | A | * | 1/1982 | Salerno | 16/83 |
| 4,982,474 | A | * | 1/1991 | Kjellstrom | 16/82 |
| 5,027,471 | A | * | 7/1991 | Barnes | 16/86 R |
| 5,369,840 | A | * | 12/1994 | Salvador et al. | 16/82 |
| 5,509,235 | A | * | 4/1996 | Chander | 49/383 |
| 5,539,954 | A | * | 7/1996 | Ambar | 16/85 |
| 5,652,998 | A | * | 8/1997 | McKenzie | 16/83 |
| 5,692,264 | A | * | 12/1997 | van der Steur | 16/82 |

(Continued)

OTHER PUBLICATIONS

Patrick F. Callahan, A collection of pictures showing potential prior art to the present invention, Jun. 28, 2013.

*Primary Examiner* — Victor Batson
*Assistant Examiner* — Jason W San
(74) *Attorney, Agent, or Firm* — John D. Long, Esq.; Long & Chybik

(57) ABSTRACT

One embodiment of the invention may be a door stopper and a method of operating same, the door stopper may comprise a base plate and a pivoting arm, the base plate having at least a first side and a second side, the first side being pivotally connected to a pivoting arm in a manner that allows the pivoting arm to move between an operating position and a storage position; wherein the door stopper attaches by its second side to a side of a door of a doorway proximate to a edge of the door in a manner that allows the pivoting arm to move from a storage position to an operating position automatically, this operating position allows the pivoting arm to prevent the door from fully closing within the doorway.

16 Claims, 6 Drawing Sheets

(56) References Cited

U.S. PATENT DOCUMENTS

| | | | | |
|---|---|---|---|---|
| 5,711,557 | A * | 1/1998 | Nicolosi | 292/288 |
| 6,003,911 | A * | 12/1999 | Sowash | 292/343 |
| 6,016,588 | A * | 1/2000 | Kamerschen | 16/82 |
| 6,327,743 | B1 * | 12/2001 | Rashid et al. | 16/82 |
| 6,487,751 | B2 * | 12/2002 | Renaud | 16/83 |
| 6,510,587 | B2 * | 1/2003 | Urschel et al. | 16/83 |
| 6,550,186 | B2 * | 4/2003 | Haq | 49/383 |
| 6,874,198 | B2 * | 4/2005 | Renaud | 16/83 |
| 7,065,830 | B2 * | 6/2006 | Bushey | 16/82 |
| 7,506,905 | B1 * | 3/2009 | George | 292/343 |
| 7,559,114 | B2 * | 7/2009 | Ranilovich | 16/82 |
| 7,904,992 | B2 * | 3/2011 | Agster et al. | 16/82 |
| 7,937,806 | B1 * | 5/2011 | Doyle | 16/82 |
| 8,060,982 | B2 * | 11/2011 | Magoz et al. | 16/83 |
| 8,186,011 | B2 * | 5/2012 | Rooney | 16/82 |
| 8,276,240 | B2 * | 10/2012 | Ritachka | 16/83 |
| 8,458,857 | B1 * | 6/2013 | Davis et al. | 16/82 |
| 8,496,278 | B2 * | 7/2013 | Lee | 292/339 |
| 8,595,899 | B2 * | 12/2013 | McRoskey et al. | 16/83 |
| 8,720,119 | B2 * | 5/2014 | Davis et al. | 49/506 |
| 2004/0055220 | A1 * | 3/2004 | Lohman | 49/322 |
| 2007/0028417 | A1 * | 2/2007 | Emmitt | 16/82 |
| 2008/0047096 | A1 * | 2/2008 | Pistone | 16/82 |
| 2008/0277949 | A1 * | 11/2008 | Emde et al. | 292/343 |
| 2009/0139050 | A1 * | 6/2009 | Junkins | 16/84 |
| 2009/0255085 | A1 * | 10/2009 | Lorenzati | 16/82 |
| 2009/0260182 | A1 * | 10/2009 | Hall | 16/82 |
| 2010/0050377 | A1 * | 3/2010 | Ritachka | 16/83 |
| 2011/0154610 | A1 * | 6/2011 | Sanz | 16/82 |
| 2012/0042590 | A1 * | 2/2012 | Ben-David Yosef | 52/204.1 |
| 2012/0272482 | A1 * | 11/2012 | Evans | 16/86 R |

* cited by examiner

DOOR STOPPER AND METHOD OF USE

STATEMENT REGARDING FEDERALLY SPONSORED RESEARCH OR DEVELOPMENT

Not Applicable.

REFERENCE TO A "MICROFICHE APPENDIX"

Not Applicable.

FIELD OF THE INVENTION

The present invention relates to door stoppers that are attached to a door. More particularity to those door stoppers that are automatically activated when a door is opened.

BACKGROUND

There is a growing awareness regarding forceful door closings occurring proximate to small children such as toddlers and the like are resulting in significant child trauma injuries. These injuries can occur when children's fingers get caught between the door's edge and its respective jamb as the door is closed forcibly, such as by a cross breeze moving through the home. The resulting child physical trauma may be so extensive that amputation may be mandated.

These concerns as well as other situations, such as those involving the elderly, who may have issues (physical or cognitive impairment [dementia, Alzheimer's, etc.]) that may otherwise limit their ability to operate door handles. Other situations requiring door stoppers may involve pets (e.g., dogs, cats, etc.) who may otherwise get locked in rooms without water or food.

To remedy these situations, care givers and the like may utilize door stoppers that attach to a doorway in such a manner that may prevent the door from closing full within its frame. Many of the door stopper devices generally require operator intervention for activating the device. One such door stopper that prevents door closures but allows the door to be fully opened has a U-shaped or C-shaped body made from resilient material. The operator places the device on a door outer side edge to reversibly retain the door side edge between the arms formed by the stopper's C or U-shape. This device positioning projects the remainder of the stopper's body outward from the door's outer side edge to allow the device to make contact with the respective door jamb when the door is moved towards a closed position to hold the door. In this operating position (e.g., operative state) the device still allows to door to be fully opened at any time to generally allow full egress through the doorway. When the operator wishes to fully close the door, the operator then removes the door stopper from the door's outer side edge and may hang the device on the door handle/knob in its storage position.

Another such door stopper is also U-shaped and generally operates in a similar manner but is placed proximate to a door hinge to generally locate the door stopper between the hinged door jamb and its respective door's inner side edge to hold the door ajar.

Still yet another door stopper attaches to side of the door by its outer side edge, this door stopper further having a horizontally sliding arm. The operator manually slides the arm out past the door's outer side edge to allow the arm to reversibly engage a respective door jamb to prevent door closure. The operator then manually slides the arm back into the storage position to allow the door to be fully closed.

Other door stoppers, when activated, may fix the distance between an opened door and its respective non-hinged door jamb. One such door stopper engages/attaches to both the door's outer side edge and to its respective door jamb to generally hold the door apart from its door jamb for a fixed distance. That stopper has double-ends with each end having a respective clamp. The operator attaches one clamp reversibly to the door edge and attaches other clamp to the respective non-hinged door jamb to hold the door open at a fixed distance from that door jamb. The operator then generally removes the door holder from the door and door jamb to generally allow the door to fully close.

Yet another such door stopper attaches a pivoting arm proximate to the door edge and attaches a separate post to the respective door jamb. The post can reversibly engage a channel within the pivoting arm to the post to fix the distance between the door edge and its jamb. The removal of the pivoting arm from the post generally permits door to be fully opened (e.g., allowing egress through the doorway.)

As seen above, such door stoppers generally require operator intervention to place the door stopper generally into its operating position. Such activation may require the operator to continually exert diligence to properly and timely activate such devices (e.g., placing the device on the door edge, engaging the device to interact with the door jamb, and the like). This diligence, however, may be impaired or even significantly reduced to a dangerous extent when the operator is focusing other activities unrelated to those activities requiring the activation of the door stopper (e.g., providing care to one or more small children, the elderly, pets, etc. to whom such door stopper devices offer their protection.)

What could be needed therefore is a door stopper that does not rely upon operator's diligence or intervention to be placed into an operating position/condition. Such a door stopper could be gravity-biased towards its operating position to automatically move at least one part into position to allow that part to contact a portion of the doorway to prevent door closure. The door stopper could then go into its operative position whenever an opening of the door releases the door stopper from its storage position. The door stopper could then stay in its operating position until subsequent operator intervention places the door stopper back into its storage or non-operating position.

SUMMARY OF ONE EMBODIMENT OF THE INVENTION

Advantages of One or More Embodiments of the Present Invention

The various embodiments of the present invention may, but do not necessarily, achieve one or more of the following advantages:

to provide a door stopper that is activated without operator interaction;

the ability to use the force of gravity to activate a doorstopper;

to provide a door stopper that is gravity-biased towards an operating position;

the ability to provide a door stopper that only requires operator action to place it in a storage position;

to provide an automatically operating door stopper that allows the door to be fully opened when the stopper is in its operating position;

the ability to provide a door stopper that requires operator action only to close a door;

to provide a simple, inexpensive, easy-to-manufacture, door stopper that allows the a care provider to utilize more of its time on supervising and providing care for those protected by the door stopper than would otherwise be utilized in activating the door stopper;

the ability to require an operator to be present at the door whenever the door stopper is placed into its storage position to ensure that the door stopper protected classes proximate to the door at that time will not be harmed by door closure;

to provide a door stopper that utilizes a cam as to adjust the operating length or throw of the door stopper that engages the door jamb; and the ability by the operator to activate or deactivate the door stopper from a position in front of or in back of the door.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a door stopper that comprises a base plate and a pivoting arm, the base plate having at least a first side and a second side, the first side being pivotally connected to a pivoting arm in a manner that allows the pivoting arm to move between an operating position and a storage position; wherein the door stopper attaches by its second side to a side of a door of a doorway proximate to a edge of the door in a manner that allows the pivoting arm to move from a storage position to an operating position automatically, this operating position allows the pivoting arm to prevent the door from fully closing within the doorway.

Another possible embodiment of the invention could be a door stopper in combination with a doorway, comprising the doorway having at least one door hingedly connected to a doorframe; a base plate having a first side and second side; a pivoting arm having a first end and second end, the first end pivotally connects to the first side to allow the pivoting arm to move between an operating position and a storage position; wherein the second side is secured to the door proximate to an edge of the door so that the pivoting arm can pivot from a storage position to an operating position when the door is opened within the doorway, the second end in the operating position blocks the door from closing within the doorway.

Yet another possible embodiment of the invention could be a method of operating a door stopper comprising the following steps, but not necessarily in the order shown; providing a door stopper of a base plate and pivot arm, the pivot arm pivotally connects to the base plate to move between a storage position and an operating position; the pivoting arm being gravity-biased towards the operating position; providing a doorway comprising of a doorframe to which a door is hingedly attached; attaching the base plate to door; opening the door to allow the pivoting arm pivot towards the operating position, the pivoting arm in the operating position holds the door ajar.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
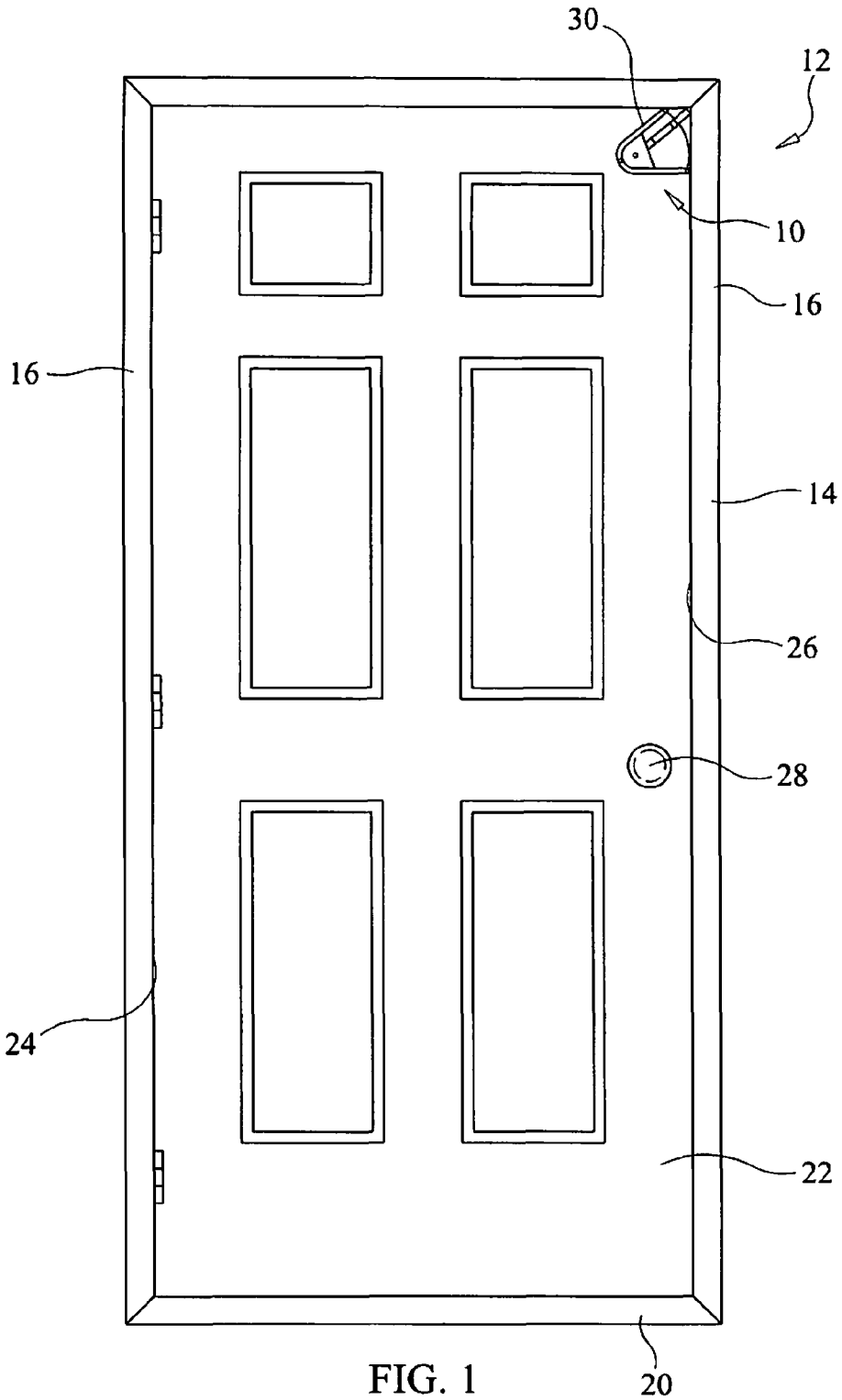
FIG. 1 is substantially a frontal elevation view of a doorway in a closed position.

The present invention 10 could comprise of a door stopper 30 and a method of its use 100. As substantially shown in FIG. 1, a one possible version of a doorway 12 to which the invention 10 could be applied (but is not limited to the use of that type of doorway 12) could comprise of a doorframe 14 to which a door 20 is hingedly attached. The doorframe 14 could comprise two side members or door jambs 16 generally connected together in spaced-apart and parallel fashion by a lintel 18 at the top of door jambs 16 and a sill 20 at the bottom of the door jambs 16. The door 22, itself could be a two-sided with a top edge, a bottom edge, an inner side edge 24 and an outer side edge 26. The inner side edge 24 could be hingedly connected to a respective door jamb 16 to allow the door 22 to pivot about its inner side edge 24 to open or close the doorway 12. The outer side edge 26 could share a locking mechanism (e.g., a door handle/latch/striker plate combination) 28 with the other door jamb 16 to reversely secure the door 22 in the closed position.

It should be noted that the invention 10 is adaptable for use with other types of doors as well, such double door doorways (not shown), and still be considered within the purview of the present invention. In a double door doorway application, a first door generally locks into the doorframe (for the closed position) while a second door locks into the first door (for its closed position.) The second door may generally be used for primary access through the doorway. The invention could be secured to the second door so that when the invention is activated (by gravity bias and by the second door being moved from a closed to an open position) towards its operating condition, the invention can come into contact with the first door (e.g., in its closed position) to prevent closure of the first door within the doorframe.

Figure 2:
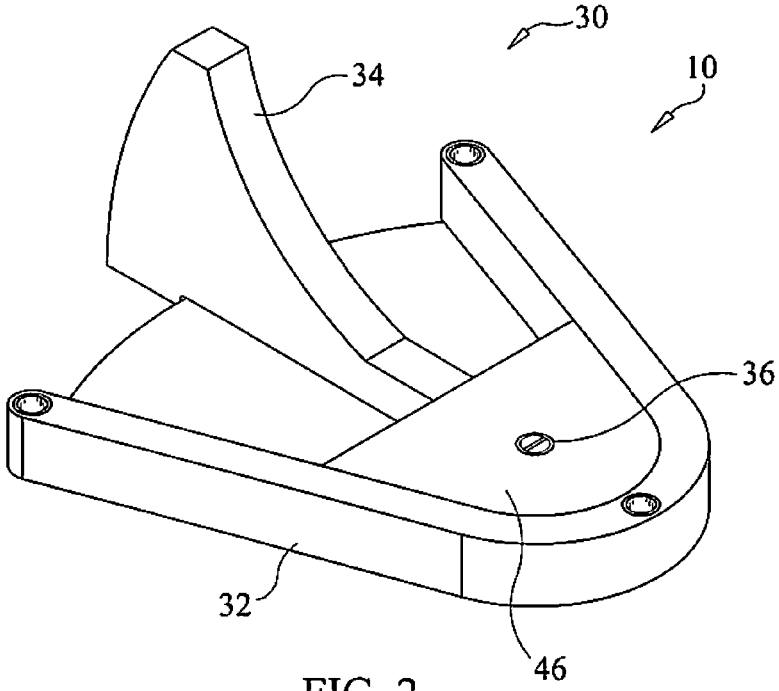
FIG. 2 is substantially a perspective view of one embodiment of the present invention.

As substantially shown in FIG. 2, the door stopper 30 in at least one embodiment could comprise of a base plate 32, pivotally connected to a pivoting arm 34 by a pivoting axle 36, a plate cover 46 rotatably holding the pivoting axle 36 in place upon the base plate 32.

Figure 3:
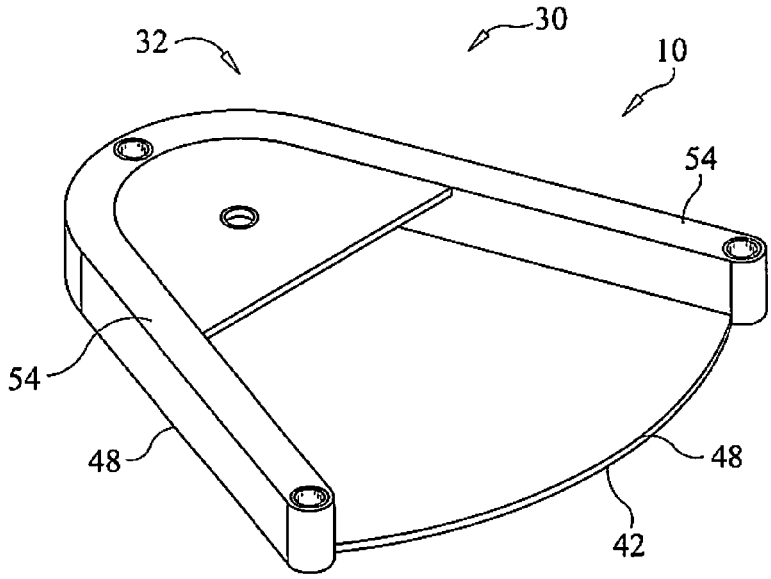
FIG. 3 is substantially a perspective view of one embodiment of the base plate of the present invention.

As substantially shown in FIG. 3, the base plate 32 could have in one embodiment have a triangularly-shaped planar body with three angled ends substantially connecting three plate edges 48 thereby generally connecting a first side 40 to a second side 42. One such plate edge 48, which is located between the other non-first angled ends, could have an arcuate shape that generally follows the radial movement of the pivoting arm 34 (as substantially shown in FIGS. 2 and 4) relative to the first axle aperture 38. A first axle aperture 38 could be proximate to a first angled end 44 to receive an end of the pivoting axle 36.

The base plate 32 could further feature a triangularly-shaped base cover 46 that could be held in a spaced-apart and parallel position from the base plate's first side 40 by raised ridges 54 in a V-shaped orientation located along those remaining (e.g., non-arcuate) plate edges 48 originating from the first angled end 44 to create an open-ended plate cavity 52. The raised ridges 54 could also serve to limit the movement of the pivoting arm 34 (as substantially shown in FIGS. 2 and 4) as pivotally attached to the base plate 32 between an operating (e.g., active) position 56 and a stored or storage (e.g., inactive) position 58. This base cover 46 could be located to substantially cover the first angle end 44 and the first axle aperture 38. The base cover 46 could feature a second axle aperture 50 that could aligned with the first axle aperture 38 to generally share a common radial axis to allow the pivoting axle 36 (as substantially shown in FIG. 5) to be rotatable held within the base cavity 52 by the base cover 46 and the base plate 32. The base cover 46 could be attached to the base plate 32 by a wide variety of suitable attachment means. In other possible invention embodiments, the pivoting axle 36 could be constructed to be rotatably attached to the base plate 32 by the first axle aperture 38 without the need for a base cover 46.

The base plate 32 could further feature a series of fastener apertures through which fasteners could pass to attach the invention 10 to side of a door (not shown.) In another embodiment, the invention 10 could forgo such fastener apertures to use other attachment means (such as adhesive pads-not shown) to attach the invention 12 to a door.

Figure 4:
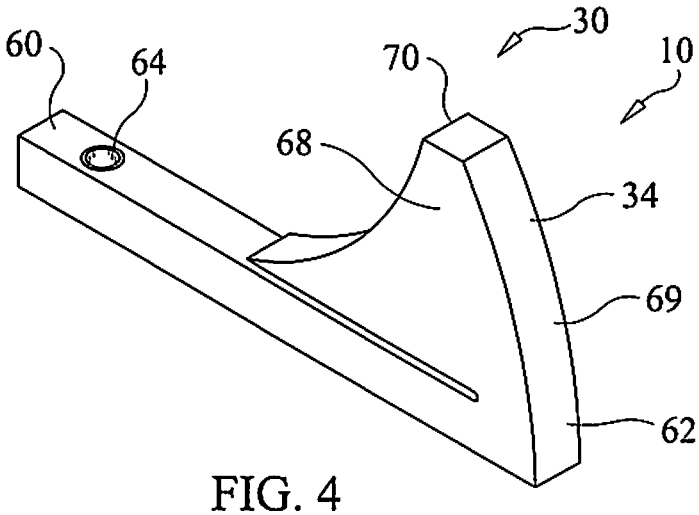
FIG. 4 is substantially a perspective view of one embodiment of the pivoting arm of the present invention.

As substantially shown in FIG. 4, the pivoting arm 34 could have a rectangular body of definite length terminating in a first arm end 60 and second arm end 62. The first arm end 60 could have an arm aperture 64 through which the pivoting axle 36 passes through to pivotally connect to the pivoting arm 34 to the base plate 32.

In one possible embodiment, wherein the pivoting axle 36 employs a lobe or a cam 72 (as substantially shown in FIG. 5) this arm aperture 64 could be sized to rotatably receive the cam 72. The rotational placement of the cam 72 relative to the base plate 32 may be used to adjust the operating length or throw of the pivoting arm 34 to compensate for differences in proportions, shapes and sizes in door jamb/doorframe/door construction for various doorways 12. (as substantially shown in FIG. 5.) Other mechanisms (not shown) may augment or substitute for the throw adjustment provided by the cam/lobe 72 and still be considered part of the invention 10. These adjustment devices may include having a pivot arm 34 that is telescopic; having the jamb projection 68 being movably attached along the length to the pivoting arm 34 and the like.

Proximate to second arm end 62 could be a triangular jamb projection 68 whose tip 70 of jamb projection 68 could project upwards and away from the pivoting arm body to contact a jamb 16 (as substantially shown in FIG. 6) during the operation of the invention 12 to keep a respective door 22 ajar relative to its doorframe 14. The tip 70 could be further positioned to be moved away from the second end arm 62 and more towards the first arm end 62. This tip location could allow an outer edge 69 of the jamb projection 68 to be arcuate (e.g., radiused, curved) canted away from second arm end 62. This outer edge 69 arcuate shape could help the outer edge 69 from improperly contacting the door jamb 16 when in the operating position (and thus preventing tip 70 from properly contacting the door jamb 16 in the operating position) (as substantially shown in FIG. 6.) To further assist the proper tip 70 placement, the second arm end 62 could protrude past the base plate/arcuate plate edge (as substantially shown in FIG. 2).

Figure 5:
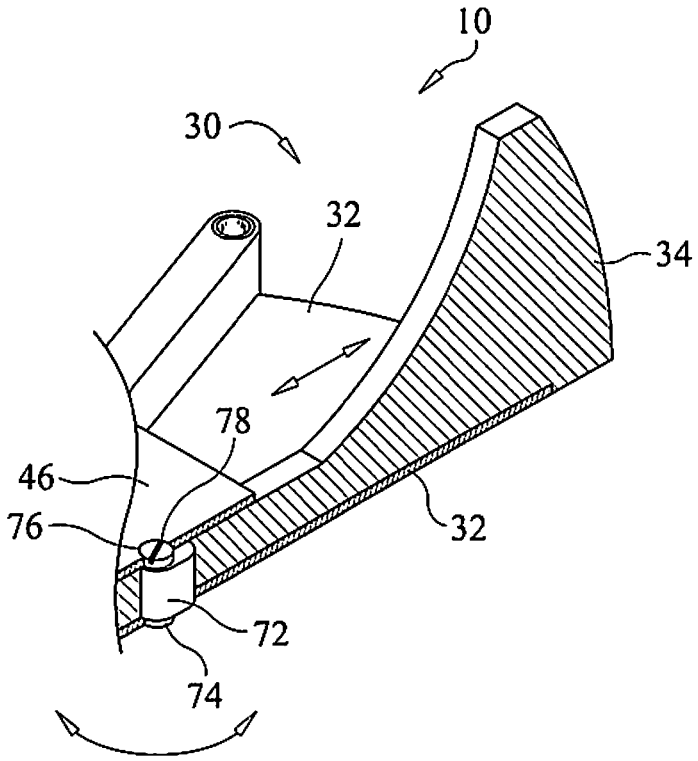
FIG. 5 is substantially a perspective cutaway view of one embodiment of the pivoting axle within the pivoting arm of the present invention.

As substantially shown in FIG. 5, the pivoting axle 36 in one possible embodiment could have a double-ended cylindrical body with a cam 72, the cam 72 could be generally located between a first axle end 74 and a second axle end 76. The first axle end 74 may be rotatably received by the first axle aperture 38 while the second axle end 76 may be rotatably received within the second axle aperture 50 of the plate cover 46. The second axle end 76 may be further shaped (e.g., have a slot 78) to allow an operator to manipulate (e.g., using a coin edge or screw driver tip-not shown) the rotational placement of the cam 72 relative to the base plate 32, pivoting arm 34 and the plate cover 46. In this manner, the pivoting axle 36 could be held rotatably held within the plate cavity 52 in a generally perpendicular orientation to the base plate 32 and the plate cover 46. This positioning could allow the pivoting arm 34 to freely pivot about the cam 72 as well as allow the operator to rotate/turn the pivoting axle 36 to move the cam 72 relative to the pivoting arm's arm aperture 64. As noted earlier, this rotational adjustment of the operating length or throw of the pivoting arm 34 allows the tip 70 to properly interact with its respective jamb (as substantially shown in FIGS. 2, 6 and 7) to hold the door ajar when in the operating position.

In another embodiment, the pivoting axle may lack a cam (as substantially shown in FIGS. 6 and 7) with first axle end 74 that is fixedly received within the first axle aperture 38 of the base plate 32. The other or second axle end 76 could be flared or otherwise suitably adjusted to keep the pivoting arm pivotally captive on the pivoting axle 36 (when the plate cover is not used-as substantially shown in FIGS. 6 and 7.)

Figure 6:
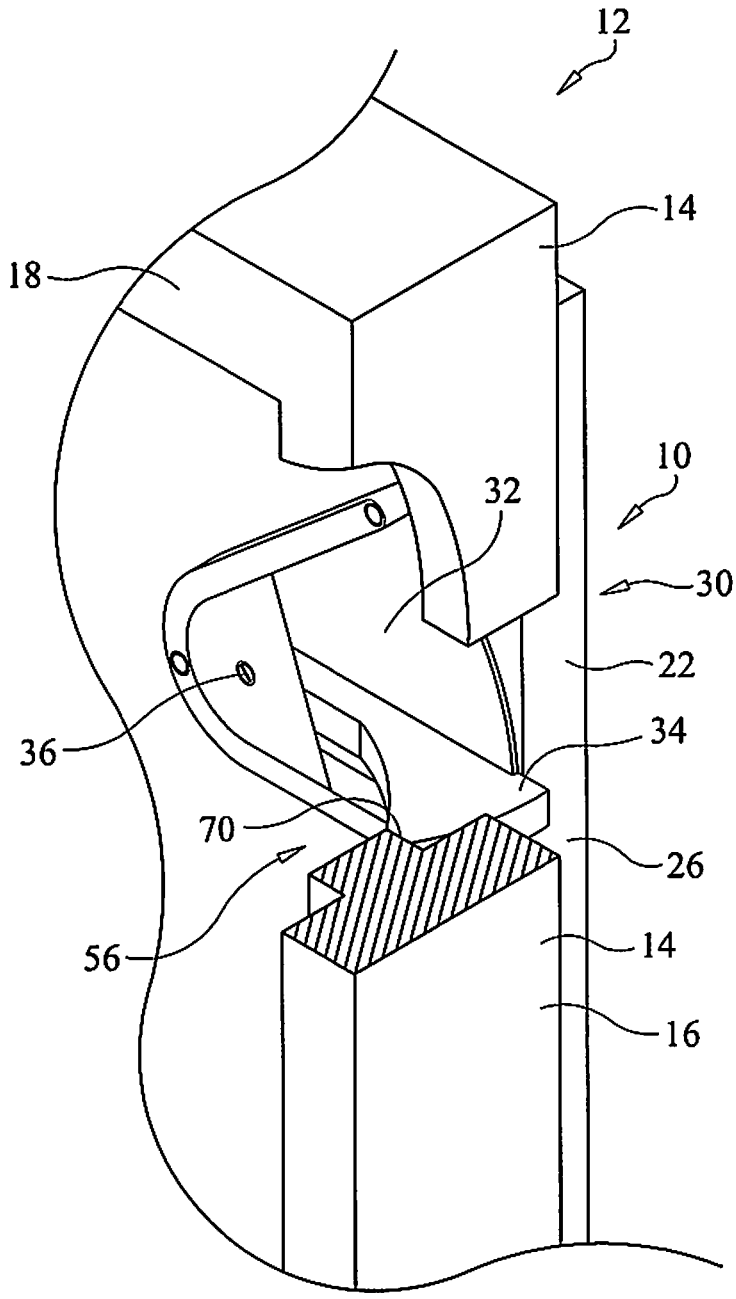
FIG. 6 is substantially a perspective cutaway view of one embodiment of the present invention in the operating position as attached to the door.
Figure 7:
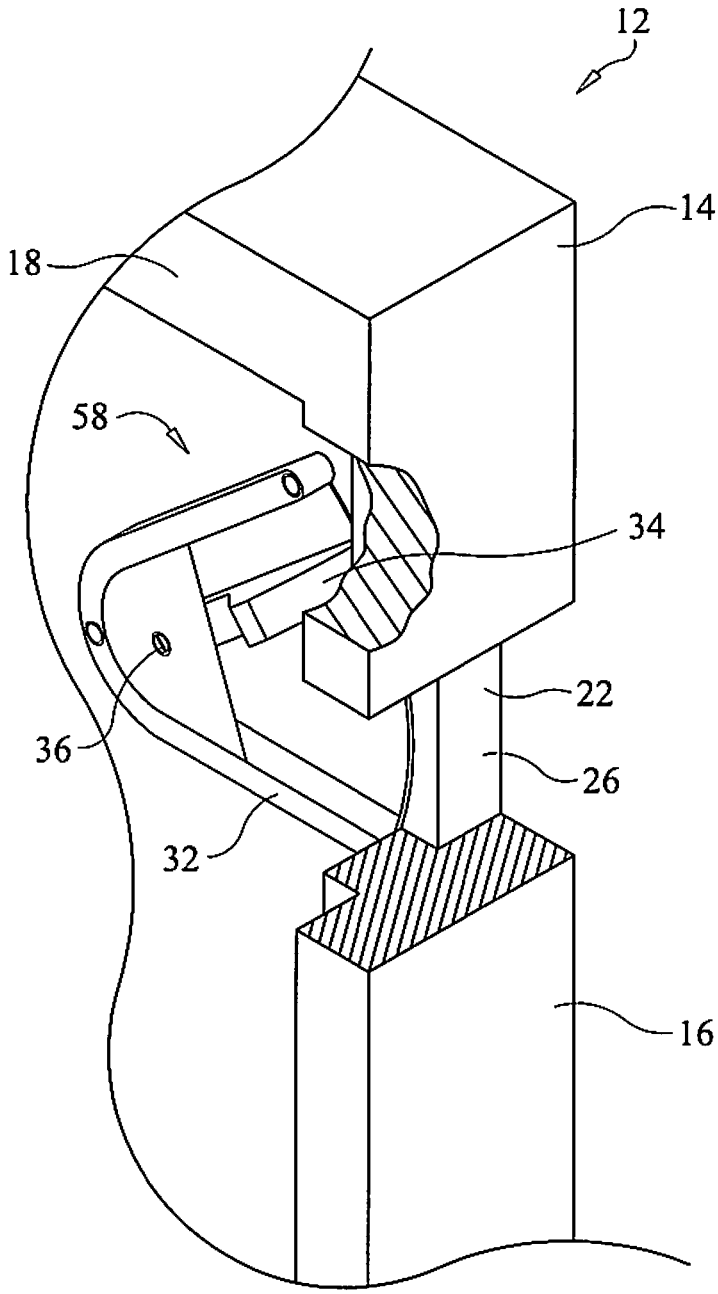
FIG. 7 is substantially a perspective cutaway view of one embodiment of the present invention in the storage position as attached to the door.

As substantially shown in FIGS. 6 and 7, the door stopper 30 could be attached a side of a door 22 of a doorway 12, and in particular the door stopper 30 could be located proximate to the outer side edge 26 by the top of the door 22. The door stopper 30 could have its pivoting arm 34 held in an upward storage position 58 by the doorframe 14 when the door 22 in closed within the doorframe 14. When the door 22 is subsequently opened (and the pivoting arm 34 is cleared of the door jamb 16) the pivoting arm 34, being gravity-biased, can move automatically downward from its storage position 58 into its operating position 56. When the door 22 is moved towards its closed position relative to the door 22, the pivoting arm (from its operating position) can then contact the door jamb 16 to generally prevent the door 22 from fully closing within the door frame 14.

Figure 8:
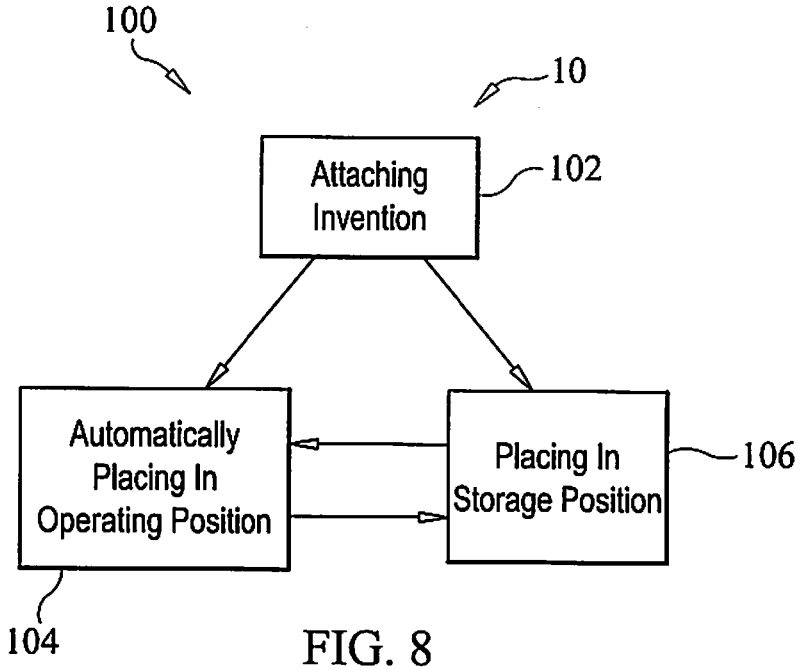
FIG. 8 is substantially a flow chart schematic showing one possible embodiment of the process or method of operating the invention.

As substantially show in FIG. 8, one possible method or process for operating the invention 100 could start with step 102, applying the invention to a doorway. The operator could survey a suitable building to determine what areas of the building, if any, door closure concerns may be present and on what doorways, if any, should the invention 10 should attached. After this initial decision is made, the necessary materials and numbers of the invention 10 could be obtained for applying the invention 10.

The door stopper could be attached to the door by suitable means. The device could be generally located on the side of the door that faces towards the doorframe and be further located proximate to its outer side edge (e.g., then non-hinged door side edge.) The device should be located high enough on the door so that small children (if they are within the door closing concern) cannot operate the door stopper but adults and the like can. The base plate should be angled relative to the door side so that the pivot arm is generally parallel to door's top/bottom edges when the pivot arm is in the operating position. The cam, if provided, can be rotated relative to the base plate to increase or shorten the operating length or throw of the pivoting arm so that the jamb projection (in its operating position) can rest its tip into the door jamb (e.g., in the door jamb corner which otherwise receives the door's outer side edge) to prevent full closure of the door into the door jamb. The jamb projection should hold the door ajar sufficiently to protect little fingers (as needed) as well as allow a breeze to pass through the doorway (as needed.)

The invention's position and adjustment should also allow the upward movement of the pivoting arm into the storage position, so that pivoting arm does not make interfering contact with the door jamb (it can rest against the door jamb but allows the door to close fully) or the lintel. When this step is substantially completed, the process 100 can proceed onto step 104, placing the invention in the operating position or onto step 106, placing the invention into the storage position.

In step 104, placing the invention in the operating position, the door could be initially shut with the pivoting arm in the upward position (e.g., storage position) causing the second end/jamb projection to be in a contact with a portion of the door jamb that does not interfere with the door edge generally being fully seated into its respective door jamb (e.g., the side of the second end/jamb projection, but not the tip, rests against a side of the door jamb to hold the pivoting arm in its upward storage position.) The door is then sufficiently opened to remove the side contact of the jamb projection/second arm end with the jamb. Moving the door's outer edge away action from the door jamb will then allow the gravity-biased pivoting arm to move downward into its operating position automatically without the need for operator intervention. When the door subsequently moves back towards contact with its non-hinged jamb, the tip of the jamb projection could contact the door jamb (e.g., into the corner formed by the door jamb that normally receives the door's outer side edge) to block full closure of the door within the doorframe and otherwise hold the door ajar.

When the door is subsequently opened (e.g., by operator, wind or other factor) gravity generally biases and holds the pivoting arm into the operating position, so that when the door is then released or is otherwise is moved towards its closed position, the pivoting arm/jamb projection continues to holds the door ajar. After this step is substantially completed, the process 100 could proceed to step 106, placing the invention in the storage position, as required.

In step 106, placing the invention in the storage position, the invention 10 is generally in its operating position with its pivoting arm able to place the jamb projection/tip into the door jamb when the door is moved towards its closed position. An operator can then rotate the pivoting arm upwards until the pivoting arm (jamb projection/second arm end) is generally into its storage position. If the operator is behind the door/side containing the invention, the operator can reach around the door's outer side edge to contact the pivoting arm and rotate it upward. The operator can hold the pivoting arm in that position and begin to close the door allowing the pivoting arm/jamb projection to slide pass the side of the door jamb (and avoiding the jamb corner). As the pivoting arm/jamb projection slides/rests upon the side of the door jamb, the operator can release the pivoting arm (now held in the upward storage position by the jamb) prior to fully shutting the door in the doorframe. As this step is substantially completed, the process 100 could proceed back to step 104 placing the invention in the operating position, as desired.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As generally described above and substantially shown in the invention provides a door stopper that is as a result of being a gravity-biased device, will put itself into the operating condition without direct operator intervention other than then the action of opening of the door to which the device is attached. The invention also provides for easy adjustment of its pivoting arm to allow the invention's usage with a wide variety of doorways. In one embodiment, this action may be provided by a pivoting axle rotatably connected to the base plate, the pivoting axle having a cam to which the pivoting arm is rotatably attached. By rotating the pivoting axle relative to the base plate, the subsequent rotation of the cam within the pivoting arm provides for adjustment of the pivoting arm's throw.

What is claimed is:

1. A door stopper comprising: a base plate and a pivoting arm, the base plate being pivotally connected to the pivoting arm in a manner that allows the pivoting arm to move between an operating position and a storage position, the pivoting arm comprising a rectangular arm body of definite length terminating in a first arm end and second arm end and a triangular jamb projection that is mounted to the pivoting arm proximate to the second arm end, the jamb projection forming a tip that is located up and away from the pivoting arm and an arcuate outer edge connecting the tip to the second arm end, the arcuate outer edge being canted away from the second arm end and towards the first arm end;

wherein the base plate is attached to a side of a door of a doorway proximate to an outer side edge of said door in a manner that allows the pivoting arm to be gravity-biased to automatically move from the storage position to the operating position upon the opening of the door in the doorway, the operating position has the pivoting arm placed to bring the tip and the arcuate outer edge beyond the outer side edge and into contact with a doorframe to prevent the door from fully closing within the doorway, the storage position has the pivoting arm placed within the limit of the outer side edge so that the tip and the arcuate outer edge do not contact the doorframe to allow the door to fully close within the doorway.

2. The door stopper of claim 1 wherein an operative length of the pivoting arm is adjustable.

3. The door stopper of claim 2 wherein the first end pivotally connects the pivoting arm to the base plate.

4. The door stopper of claim 1 further comprising of a pivoting axle that pivotally connects the pivoting arm to the base plate.

5. The door stopper of claim 4 wherein the pivoting axle further forms a cam, the cam being movably received within the first arm end.

6. The door stopper of claim 5 wherein the cam is rotated relative to the base plate to adjust an operating length of the pivoting arm relative to the base plate.

7. The door stopper of claim 5 wherein the cam is rotated relative to the base plate to adjust a placement of a triangular jamb projection relative to a door jamb.

8. A door stopper in combination with a doorway, comprising:

(A) the doorway having at least one door hingedly connected to a doorframe;

(B) a base plate;

(C) a pivoting arm having a first end and second end, the first end pivotally connects to the base plate to allow the pivoting arm to move between an operating position and a storage position, the pivoting arm comprising a rectangular arm body of definite length terminating in a first arm end and second arm end and a triangular jamb projection that is mounted to the pivoting arm proximate to the second arm end, the jamb projection forming a tip that is located up and away from the pivoting arm and an arcuate outer edge connecting the tip to the second arm end, the arcuate outer edge being canted away from the second arm end and towards the first arm end;

wherein the base plate is attached to a side of a door of a doorway proximate to an outer side edge of said door in a manner that allows the pivoting arm to be gravity-biased to automatically move from the storage position to the operating position upon the opening of the door in the doorway, the operating position has the pivoting arm placed to bring the tip and the arcuate outer edge beyond the outer side edge and into contact with a doorframe to prevent the door from fully closing within the doorway, the storage position has the pivoting arm placed within the limit of the outer side edge so that the tip and the arcuate outer edge do not contact the doorframe to allow the door to fully close within the doorway.

9. The door stopper combination of claim 8 wherein an operating length of the pivoting arm is adjustable.

10. The door stopper combination of claim 8 wherein the pivoting arm further supports a jamb projection that can contact a doorframe when the pivoting arm is placed in the operating position.

11. The door stopper combination of claim 10 further comprises a pivoting axle having a cam, one end of the pivoting axle being rotatably received within the base plate while the cam is movably received within the pivoting arm wherein rotation of the pivoting axle relative to the base plate moves the cam to adjust the operating length of the pivoting arm.

12. A method of operating a door stopper comprising the following steps, but not necessarily in the order shown:

(A) providing a door stopper of a base plate and a pivoting arm, the pivoting arm having a first end and second end, the first end pivotally connects to the base plate to allow the pivoting arm to move between an operating position and a storage position, the pivoting arm comprising a rectangular arm body of definite length terminating in a first arm end and second arm end and a triangular jamb projection that is mounted to the pivoting arm proximate to the second arm end, the jamb projection forming a tip that is located up and away from the pivoting arm and an arcuate outer edge connecting the tip to the second arm end, the arcuate outer edge being canted away from the second arm end and towards the first arm end;

(B) providing a doorway comprising a doorframe to which a door is hingedly attached;

(C) attaching the base plate to a side of the door of the doorway proximate to an outer side edge of said door (D) opening the door in the doorway that allows the pivoting arm to be gravity-biased to automatically move from the storage position to the operating position, the operating position has the pivoting arm placed to bring the tip and the arcuate outer edge beyond the outer side edge and into contact with the doorframe to prevent the door from fully closing within the doorway, the storage position has the pivoting arm placed within the limit of the outer side edge so that the tip and the arcuate outer edge do not contact the doorframe to allow the door to fully close within the doorway.

13. The method of operating a door stopper of claim 12 further comprising contacting a door jamb with the pivot arm to hold the door ajar.

14. The method of operating a door stopper of claim 13 further comprising moving the pivoting arm to the storage position to allow the door to close within the doorframe.

15. The method of operating a door stopper of claim 13 further comprising holding the pivoting arm in the storage position by the doorframe when the door is closed within the doorframe.

16. The method of operating a door stopper of claim 13 further comprising of turning a pivoting axle, the pivoting axle comprising a cam, the pivoting axle that movably connects the pivoting arm to the base plate in a manner that further rotates the cam within the pivoting arm to adjust an operating length of the pivoting arm.

* * * * *